United States Patent [19]

Mann

[11] Patent Number: 4,616,851

[45] Date of Patent: Oct. 14, 1986

[54] BOOK STRUCTURE

[75] Inventor: Philip Mann, New York, N.Y.

[73] Assignee: Tuffy Books, Inc., Harrison, N.Y.

[21] Appl. No.: 695,417

[22] Filed: Jan. 28, 1985

Related U.S. Application Data

[63] Continuation of Ser. No. 394,273, Jul. 1, 1982, abandoned.

[51] Int. Cl.[4] ..... B42D 1/00

[52] U.S. Cl. ..... 281/15 R; 281/15 A; 281/34; D19/26

[58] Field of Search ..... 281/15 R, 15 A, 15 B, 281/34; D19/26, 27

[56] References Cited

U.S. PATENT DOCUMENTS

| | | | |
|---|---|---|---|
| D. 278,722 | 5/1985 | Becker et al. | D19/25 |
| 506,160 | 10/1893 | Connolly | 281/15 R |
| 1,136,598 | 4/1915 | Gould | 281/34 |
| 2,215,163 | 9/1940 | Shedd | 281/15 A X |
| 4,161,833 | 7/1979 | Wagner | 40/539 |
| 4,200,945 | 5/1980 | Ellis | 281/15 A |
| 4,244,603 | 1/1981 | De Monti | 281/15 R |
| 4,246,711 | 1/1981 | Wagner | 40/312 |
| 4,487,590 | 12/1984 | Becker et al. | 446/147 |
| 4,490,123 | 12/1984 | Becker et al. | 446/204 |

FOREIGN PATENT DOCUMENTS

| | | | |
|---|---|---|---|
| 2364578 | 12/1973 | Fed. Rep. of Germany | 281/15 A |
| 7830651 | 1/1978 | Fed. Rep. of Germany . | |
| 7901831 | 5/1979 | Fed. Rep. of Germany . | |
| 1313254 | 4/1973 | United Kingdom . | |

OTHER PUBLICATIONS

*Funny Fingers,* Salisbury, K. & Allen, J., 1971, Western Publishing Co, Inc.

*Primary Examiner*—Paul A. Bell

*Attorney, Agent, or Firm*—Lewis H. Eslinger; Alvin Sinderbrand

[57] ABSTRACT

In a book made up of a plurality of sheet members respectively constituting a pair of covers and a number of leaves therebetween and being fastened together with a spine of the book in a manner to permit relative angular displacements of the sheet members about the spine for opening and closing the book, at least the sheet members constituting the covers, and preferably all of the sheet members, are substantially stiff and have elongated openings extending therethrough along corresponding edge portions of the respective sheet members, and all of such openings are aligned when the book is closed and are accessible from opposite sides of the respective sheet members so that a hand can be extended through the openings for carrying the closed book.

5 Claims, 7 Drawing Figures

FIG. 3
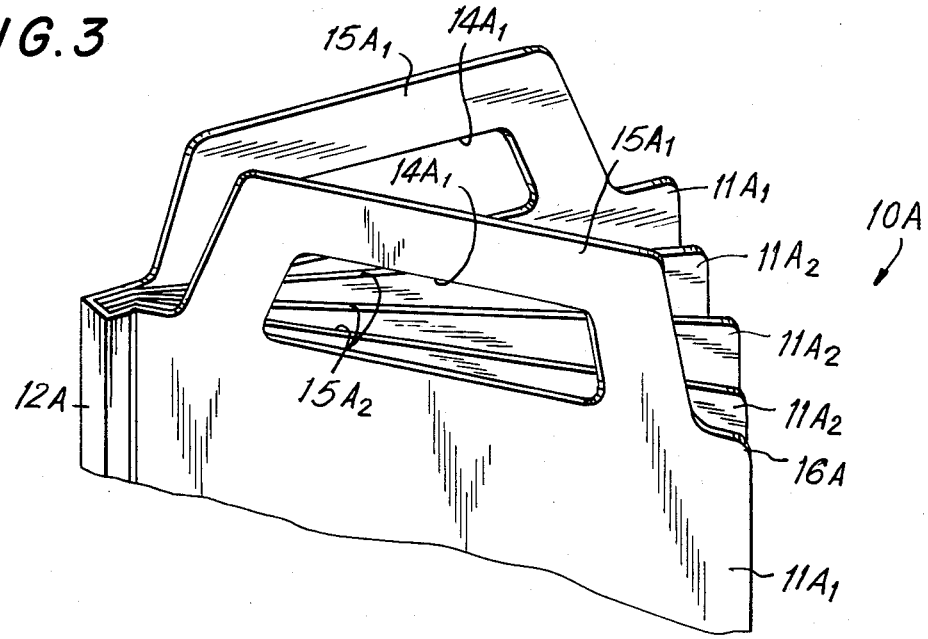
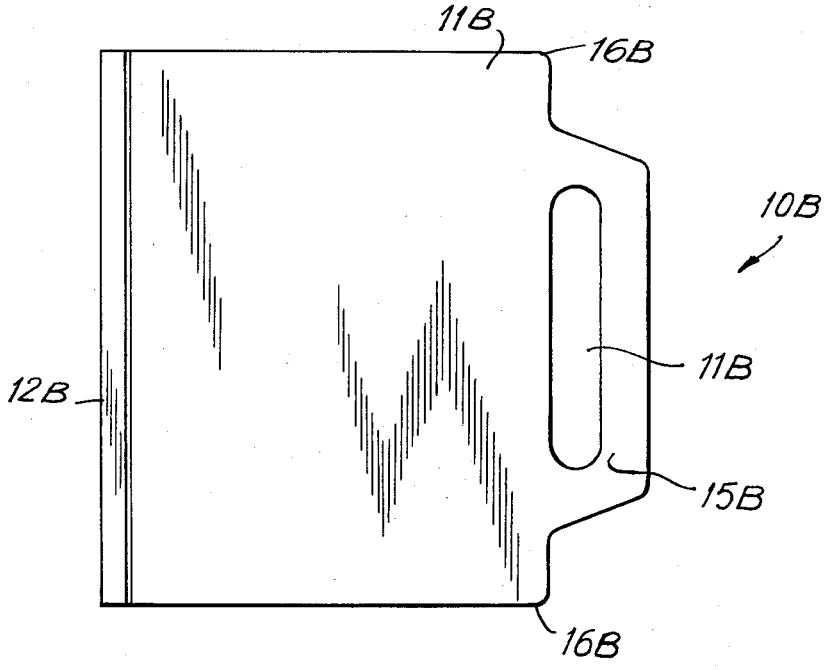
FIG. 4

FIG. 5
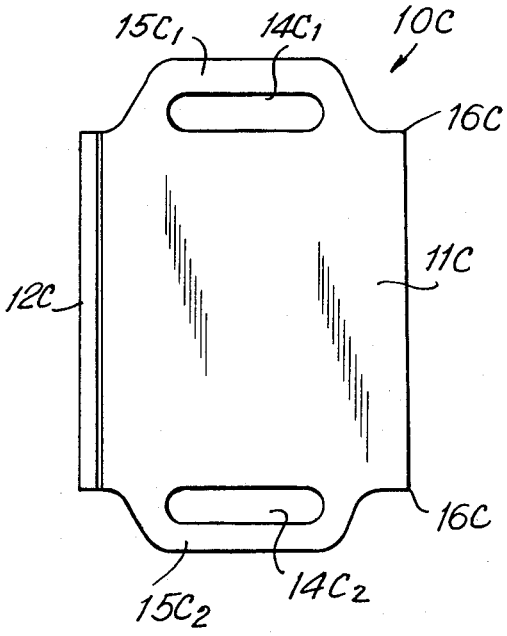
FIG. 6
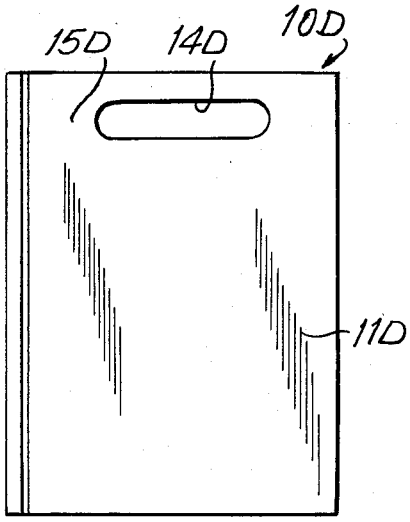
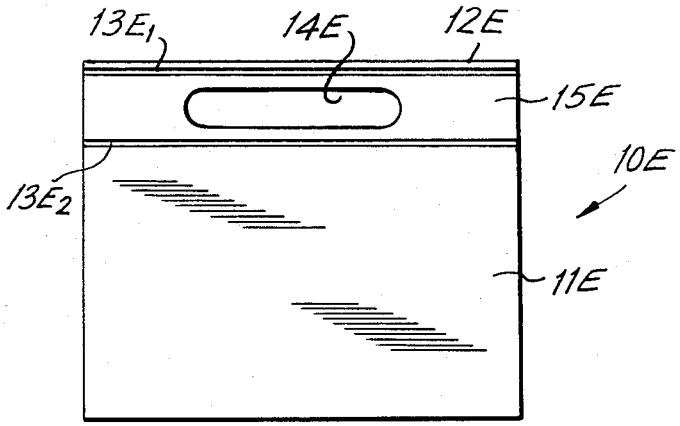
FIG. 7

BOOK STRUCTURE

This is a continuation of application Ser. No. 06/394,273, filed July 1, 1982 now abandoned.

BACKGROUND OF THE INVENTION

1. Field of the Invention

This invention relates generally to a novel book structure, and more particularly is directed to a book structure which facilitates the carrying thereof.

2. Description of the Prior Art

It has been known to provide a carrying case of leather, pliable plastic, canvas or the like adapted to contain a book or books and having a handle attached to the case for convenience in carrying the latter. It has also been known to provide a strap or straps adapted to be secured around one or more books, and which may also have a handle attached thereto for convenience in carrying the book or books. However, the foregoing arrangements for carrying books require manipulations by the user for either placing the book or books in the carrying case or for securing the strap or straps around the books, so that such arrangements are inherently relatively inconvenient.

OBJECTS AND SUMMARY OF THE INVENTION

Accordingly, it is an object of this invention to provide a book structure by which convenient carrying of the book is promoted.

Another obJect of the invention is to provide a book structure of appealing novelty which will be particularly attractive to children so that children will be thereby induced to carry the books with them and to read the contents of the books when in a condition of repose.

In accordance with an aspect of this invention, in a book comprising a plurality of sheet members respectively constituting a pair of covers and leaves therebetween and being fastened together along a spine of the book in a manner to permit relative angular displacements of the sheet members about the spine for opening and closing the book, at least one of the sheet members is of a substantially stiff material, such as, cardboard, and has an elongated opening extending therethrough along at least one edge portion of the respective sheet member, and each such opening is accessible from the opposite sides of the respective sheet member when the book is closed so that a hand can be extended through the opening for carrying the book.

In a preferred embodiment of the invention, all of the sheet members constituting the covers and leaves therebetween have aligned elongated openings extending therethrough along corresponding edge portions which may desirably extend beyond adjacent ends of the edges of the sheet members which are at right angles to the longitudinal axes of the elongated openings so that the edge portions of the sheet members with the elongated openings therein form a sturdy handle-like extension as an integral part of the book when the latter is closed.

The above, and other objects, features and advantages of the invention, will be apparent in the following detailed description of illustrative embodiments thereof which is to be read in connection with the accompanying drawings.

BRIEF DESCRIPTION OF THE DRAWINGS

FIG. 3 is a fragmentary perspective view corresponding to the upper portion of FIG. 1, but showing another embodiment of this invention; and FIGS. 4, 5, 6 and 7 are plan views, on a reduced scale, of books according to still other respective embodiments of the invention.

DESCRIPTION OF THE PREFERRED EMBODIMENTS

Figure 1:
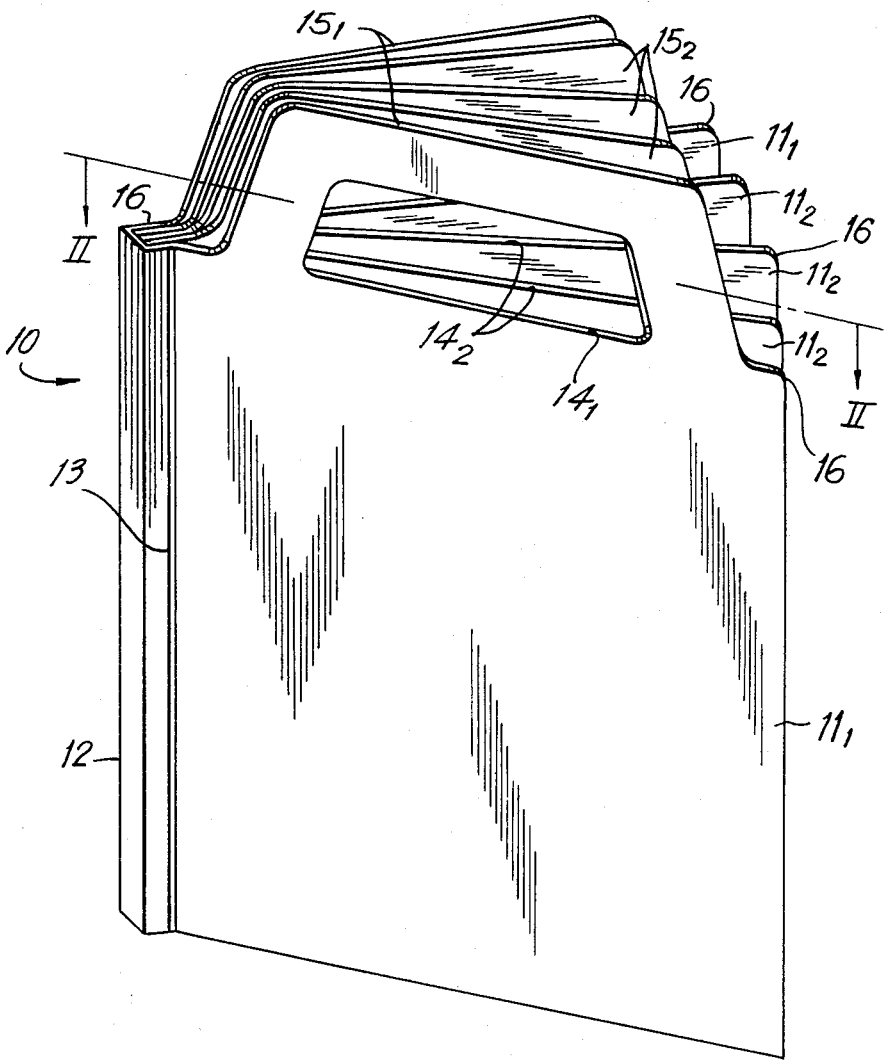
FIG. 1 is a perspective view of a book according to one embodiment of this invention shown in a partially opened condition.
Figure 2:
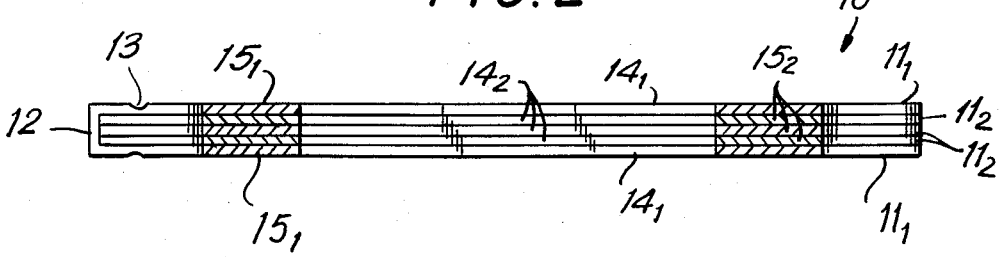
FIG. 2 is a detailed sectional view taken along the line II—II on FIG. 1, but showing the book in its closed condition.

Referring to the drawings in detail, and initially to FIGS. 1 and 2 thereof, it will be seen that a book 10 according to an embodiment of this invention comprises a number of sheet members respectively constituting a pair of covers $\mathbf{11}_1$ and a plurality of leaves $\mathbf{11}_2$ therebetween. The sheet members constituting covers $\mathbf{11}_1$ and leaves $\mathbf{11}_2$ are all conventionally bound or fastened together along a spine 12 of book 10 in a manner to permit relative angular displacement of the covers and leaves about such spine for opening and closing the book.

In the book 10 according to this invention which is particularly suited for use as a children's book, the leaves $\mathbf{11}_2$ as well as the covers $\mathbf{11}_1$ are formed of a relatively stiff material, such as, cardboard or the like, so that the relative angular displacements thereof are made possible by providing each of the sheet members constituting the covers $\mathbf{11}_1$ and leaves $\mathbf{11}_2$ with a weakened or relatively flexible linear zone indicated at 13 and which extends along spine 12. Further, in book 10 according to this invention, all of covers $\mathbf{11}_1$ and leaves $\mathbf{11}_2$ are formed with elongated openings $\mathbf{14}_1$ and $\mathbf{14}_2$, respectively, extending therethrough along corresponding edge portions $\mathbf{15}_1$ and $\mathbf{15}_2$ of the covers and leaves, respectively, which are normal or at right angles to the spine 12 of the book. The openings $\mathbf{14}_1$ and $\mathbf{14}_2$ in edge portions $\mathbf{15}_1$ and $\mathbf{15}_2$ of the covers and leaves, respectively, are all aligned with each other when the book is closed, as specifically shown on FIG. 2, so that each of the openings $\mathbf{14}_1$ and $\mathbf{14}_2$ is accessible from the opposite sides of the respective sheet member when the book is closed to permit a hand to be extended through each of the openings for carrying the book 10.

In the book 10, each of the edge portions $\mathbf{15}_1$ and $\mathbf{15}_2$ at the upper margin of the respective cover $\mathbf{11}_1$ or leaf $\mathbf{11}_2$ extends beyond the adjacent upper ends 16 of the edges of the respective cover or leaf which are at right angles to the longitudinal axis of the elongated opening $\mathbf{14}_1$ or $\mathbf{14}_2$ therein. Therefore, in the book 10, edge portions $\mathbf{15}_1$ and $\mathbf{15}_2$ with the elongated openings $\mathbf{14}_1$ and $\mathbf{14}_2$, respectively, therein, form a sturdy, handle-like extension as an integral part of book 10 particularly when the latter is in its closed position.

Such handle as an integral part of the book 10 is easily grasped by a young child and provides the book with an attractive, novel appearance, thereby encouraging the young child to carry the book when moving about so that the book will be conveniently at hand to be read whenever the child is in a condition of repose.

In the book 10 according to the embodiment of the invention illustrated on FIGS. 1 and 2, the elongated openings $14_1$ and $14_2$ for forming the handle by which the book can be carried are formed in all of the sheet members constituting the covers $11_1$ and the leaves $11_2$ therebetween. However, as shown on FIG. 3, a book 10A according to this invention may have elongated openings $14A_1$ extending through only its covers $11A_1$ along edge portions $15A_1$ which, in the closed condition of the book, extend beyond the adjacent edges $15A_2$ of leaves $11A_2$. In the case of book 10A, leaves $11A_2$ bound between covers $11A_1$ at spine 12A may, if desired, be formed of a relatively thin or flexible sheet material, while only covers $11A_1$ are formed of a stiff material for affording the requisite strength and rigidity to the handle-like extension presented by edge portions $15A_1$ with elongated openings $14A_1$ therein when book 10A is in its closed condition.

In the books 10 and 10A the elongated openings $14_1$ and $14_2$ or $14A_1$ have been shown to be formed through respective sheet members of the books along edge portions thereof which are normal, or at right angles to the spine 12 or 12A. However, as shown on FIG. 4, a book 10B in accordance with this invention may have an elongated opening 14B extending through one or more of the sheet members 11B constituting the covers and intervening leaves of the book along an edge portion 15B of the respective sheet member which is opposite to the spine 12B of book 10B at which the several sheet members are fastened together. It will be appreciated that, when the book 10B according to this invention is carried, the user's hand is extended through the elongated opening or openings 14B and the book is transported with its spine 12B lowermost.

Referring now to FIG. 5, it will be seen that, in a book 10C according to another embodiment of this invention, at least the sheet members 11C thereof constituting the covers, and preferably also the sheet members constituting the intervening leaves, are formed with elongated openings $14C_1$ and $14C_2$ extending therethrough along edge portions $15C_1$ and $15C_2$ which are at opposed edges of the sheet member. Thus, for example, in the book 10C illustrated on FIG. 5, the elongated openings $14C_1$ and $14C_2$ are formed along edge portions $15C_1$ and $15C_2$, respectively, which are at the opposed edges of the respective sheet members 11C extending normal to the spine 12C so that book 10C can be carried with either the edge portion $15C_1$ or the edge portion $15C_2$ uppermost.

In all of the previously described embodiments of the invention, the edge portions $15_1$ and $15_2$, $15A_1$, 15B or $15C_1$ and $15C_2$ have extended beyond adjacent ends 16, 16A, 16B or 16C of the edges of the respective sheet members which are at right angles to the longitudinal axes of the elongated openings $14_1$ and $14_2$, $14A_1$, 14B or $14C_1$ and $14C_2$, respectively, to form handle-like extensions which project from the remainder of the respective book. However, as shown on FIG. 6, in a book 10D according to this invention, each opening 14D formed through a sheet member 11D constituting a cover or leaf of the book may extend along an edge portion 14D which is within the usual rectangular margin of the cover or leaf.

Further, as shown on FIG. 7, in a book 10E according to this invention, each elongated opening 14E may be formed through the respective sheet member 11E along an edge portion 15E which is included in the spine 12E. In this case, in order to ensure that each opening 14E will be accessible from opposite sides of the respective sheet member 11E when the book 10E is closed, all of the sheet members constituting the pair of covers and the intervening leaves have to be provided with aligned elongated openings 14E. In the book 10E, the flexible linear zone about which each of the sheet members 11E is angularly displaceable may be disposed between the respective opening 14E and the spine 12E, as indicated at $13E_1$ on FIG. 7, or at the side of the opening 14E remote from spine 12E, as indicated at $13E_2$.

Although specific embodiments of the invention have been described in detail herein with reference to the drawings, it is to be understood that the invention is not limited to those precise embodiments, and that various changes and modifications have been effected therein by one skilled in the art without departing from the scope or spirit of the invention as defined in the appended claims.

What is claimed is:

1. A children's book comprising a plurality of substantially identical sheet members each having a top edge, a bottom edge, a spine edge and an outer edge, said sheet members respectively constituting a pair of covers and leaves therebetween and being fastened together adjacent to said spine edges to form a spine and to permit relative angular displacements of said sheet members about said spine for opening and closing the book; wherein:

all of the sheet members are formed of a substantially stiff cardboard-like material;

all of said sheet members having substantially identical elongated openings extending therethrough adjacent to at least one of said top and outer edges, said openings are aligned when the book is closed; and said openings are accessible from opposite sides of the book when the book is closed to form a handle portion in the book and are large enough that a child's hand can be extended through the openings for carrying the book, thereby inducing the child to carry and read the book.

2. A children's book comprising a plurality of substantially identical sheet members respectively constituting a pair of covers and leaves therebetween and being fastened together along a spine of the book in a manner to permit relative angular displacements of said sheet members about said spine for opening and closing the book; wherein:

all of the sheet members are formed of a substantially stiff cardboard-like material;

all of said sheet members have substantially elongated openings extending therethrough along one edge portion thereof and along another edge portion thereof, said openings being aligned when the book is closed; and said openings are accessible from opposite sides of the book when the book is closed to form a handle portion in the book so that a child's hand can be extended through the openings for carrying the book, thereby inducing the child to carry and read the book.

3. A book according to claim 2; in which said one edge portion and said other edge portion are at opposed edges of said sheet members.

4. A book according to claim 2; in which said one edge portion extends beyond adjacent ends of edges of said sheet members to form a handle-like extension as an integral part of the book.

5. A children's book comprising a plurality of substantially identical sheet members respectively constituting a pair of covers and leaves therebetween and being fastened together along a spine of the book in a manner to permit relative angular displacements of said sheet members about said spine for opening and closing the book; wherein:

all of the sheet members are formed of a substantially stiff cardboard-like material;

all of said sheet members have elongated openings extending therethrough along said spine of the book, said openings being aligned when the book is closed; and said openings are accessible from opposite sides of the book when the book is closed to form a handle portion in the book so that a child's hand can be extended through the openings for carrying the book, thereby inducing the child to carry and read the book.

* * * * *